US006938279B1

(12) United States Patent
Henderson

(10) Patent No.: US 6,938,279 B1
(45) Date of Patent: Sep. 6, 2005

(54) DRAIN PLUG

(75) Inventor: Gregg A. Henderson, Munroe Falls, OH (US)

(73) Assignee: The Little Tikes Company, Hudson, OH (US)

( * ) Notice: Subject to any disclaimer, the term of this patent is extended or adjusted under 35 U.S.C. 154(b) by 58 days.

(21) Appl. No.: 10/144,052

(22) Filed: May 10, 2002

(51) Int. Cl.[7] ..... A47K 1/14
(52) U.S. Cl. ..... 4/295; 4/286; 4/287
(58) Field of Search ..... 4/286, 287, 288, 4/295, 688

(56) References Cited

U.S. PATENT DOCUMENTS

| | | | | | |
|---|---|---|---|---|---|
| 1,300,593 | A | | 4/1919 | Fairchild | |
| 1,630,351 | A | | 5/1927 | Mortimer | |
| 1,630,352 | A | | 5/1927 | Mortimer | |
| 2,500,674 | A | * | 3/1950 | Gleason | 4/287 |
| 2,838,769 | A | | 6/1958 | Lengyel | |
| 3,010,120 | A | * | 11/1961 | Young | 4/295 |
| 3,609,776 | A | * | 10/1971 | Haldopoulos et al. | 4/295 |
| 3,703,302 | A | * | 11/1972 | Demler, Sr. | 285/139.1 |
| 3,995,333 | A | * | 12/1976 | Stephens | 4/286 |
| 4,160,293 | A | * | 7/1979 | Niemann | 4/291 |
| 4,188,676 | A | * | 2/1980 | Tolnai et al. | 4/295 |
| 4,232,407 | A | * | 11/1980 | Williams | 4/287 |
| 4,339,832 | A | * | 7/1982 | Cuschera | 4/287 |
| 4,369,531 | A | * | 1/1983 | Swanson | 4/295 |
| 4,420,844 | A | * | 12/1983 | Puckett et al. | 4/295 |
| 4,586,203 | A | * | 5/1986 | Westgerdes | 4/287 |
| 4,720,877 | A | | 1/1988 | Watts | |
| 4,932,082 | A | * | 6/1990 | Ridgeway | 4/287 |
| 5,226,196 | A | * | 7/1993 | Humlan | 4/295 |
| 5,485,707 | A | * | 1/1996 | Wilkes | 52/741.3 |
| 5,592,701 | A | | 1/1997 | Smith | |
| 5,749,105 | A | | 5/1998 | Bruno et al. | |
| 5,819,328 | A | * | 10/1998 | Lewis | 4/295 |
| 5,826,855 | A | | 10/1998 | Dick | |
| 5,881,397 | A | * | 3/1999 | Hobbs | 4/287 |
| 6,195,819 | B1 | * | 3/2001 | Wang | 4/689 |

* cited by examiner

*Primary Examiner*—Henry Bennett
*Assistant Examiner*—Amanda Wieker
(74) *Attorney, Agent, or Firm*—Renner, Otto, Boisselle & Sklar, LLP

(57) ABSTRACT

A container having an opening that extends through the container. The outer surface of the container includes a tapered section located within the opening. The tapered section extends from the bottom of the container towards the inner surface of the container. A plug is retained within the opening of the container. The plug has a head, an upright section and a base with a peripheral edge. The peripheral edge of the base contacts the tapered section of the container to enable the plug to remain in an upright drainage position.

13 Claims, 4 Drawing Sheets

DRAIN PLUG

TECHNICAL FIELD OF THE INVENTION

The present invention relates in general to a plug for a liquid reservoir, and more particularly to a plug for a portable container or basin used to hold liquids.

BACKGROUND OF THE INVENTION

Portable containers, such as a plastic swimming pool or a water tub, use plugs to seal openings in the container.

A portable swimming pool for the backyard uses a plug to cover a hole to enable the swimming pool to hold water. Portable swimming pools generally have a drain incorporated at the bottom of the pool whereby water can be drained from the pool, if desired. The drains of conventional pools or portable containers incorporate many different types of plug mechanisms. Simple detachable stoppers have been used to plug the holes. The simple detachable stoppers are inexpensive to manufacture but they are easy to lose. Permanently attached plug assemblies that are attached to an aperture formed in the bottom panel of the pool have also been used. However, the permanently attached plug assemblies are generally expensive to manufacture and install in the pool.

Multiple piece plugs have also been used to cover the holes in portable pools or containers. The multiple piece plugs are generally required to be attached from both sides of the hole. As a result, the assembly of the multiple piece plugs is cumbersome and labor intensive thereby increasing the price of the product. The multiple piece plugs generally include stationary pieces as well as removable pieces. The removable pieces are easy to lose and potentially create safety hazards for children.

Therefore, it is desirable to provide an inexpensive drain plug that is retained with in the opening in a container.

SUMMARY OF THE INVENTION

The invention is directed to a container with a plug that enables the container to store a liquid. The container is defined by an inner surface, an outer surface, a bottom and sides extending upwards from the bottom. The container also has an opening extending through the container. The outer surface of the container includes a tapered section located below the opening. The tapered section extends from the bottom of the container towards the inner surface of the container.

A plug is retained within the opening in the container. The plug has an integrally formed head, upright portion and a base. The head of the plug is beveled such that the circumference of the head decreases from the top edge to the bottom edge. The base of the plug has a peripheral edge. The peripheral edge of the base contacts the tapered section of the container to enable the plug to remain in an upright drainage position.

BRIEF DESCRIPTION OF THE DRAWINGS

Further aspects of the invention and their advantages may be discerned from the following description when taken in conjunction with the drawings, in which like characters number like parts and in which.

DETAILED DESCRIPTION OF ILLUSTRATED EMBODIMENT

Figure 1:
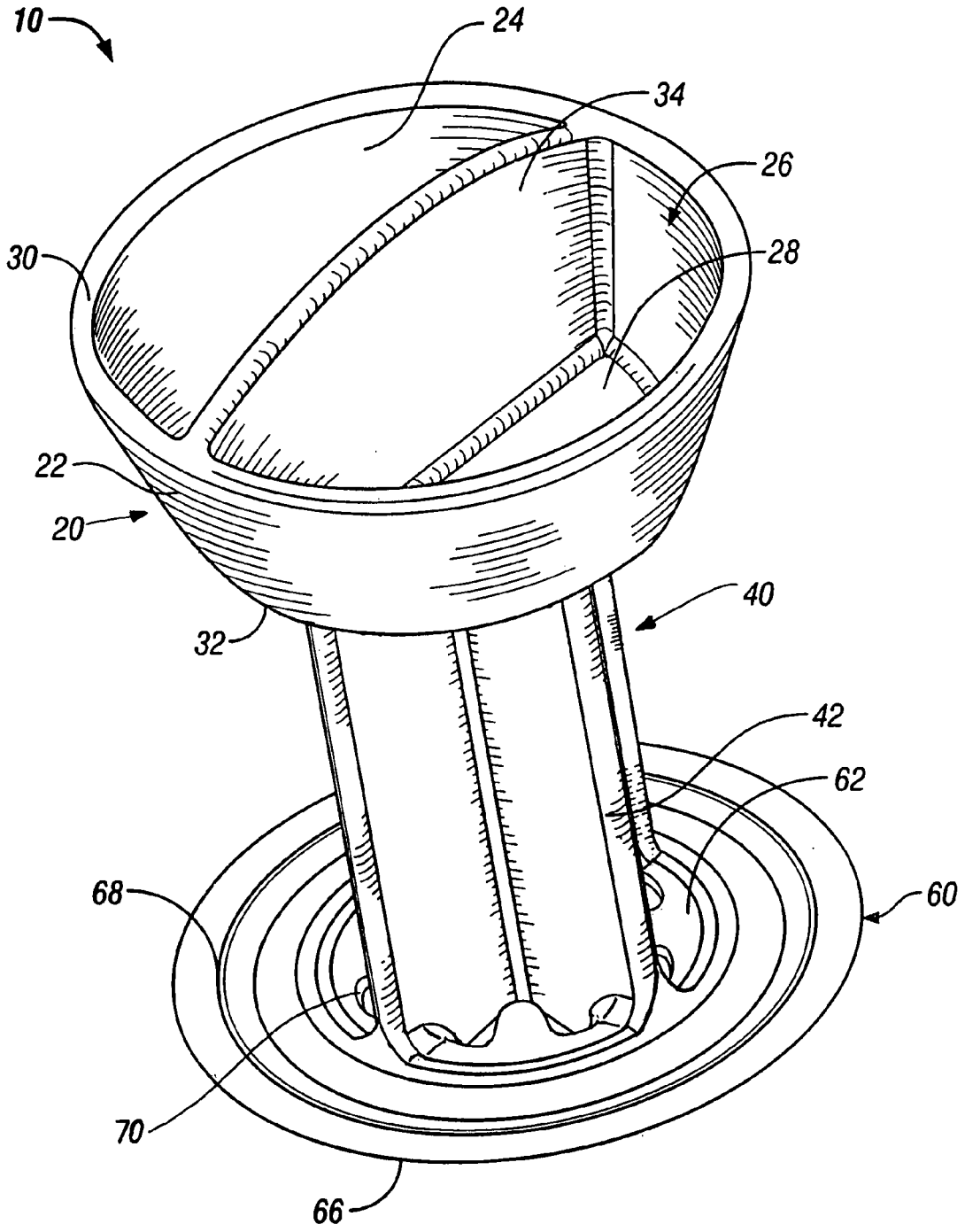
FIG. 1 is a perspective view of the drain plug of the present invention.

As shown in FIG. 1, the drain plug of the present invention is indicated in general at 10. The drain plug includes a head 20, an upright section 40 and a base 60. The drain plug 10 is molded into a single piece of plastic, such as polyvinyl chloride.

Figure 3:
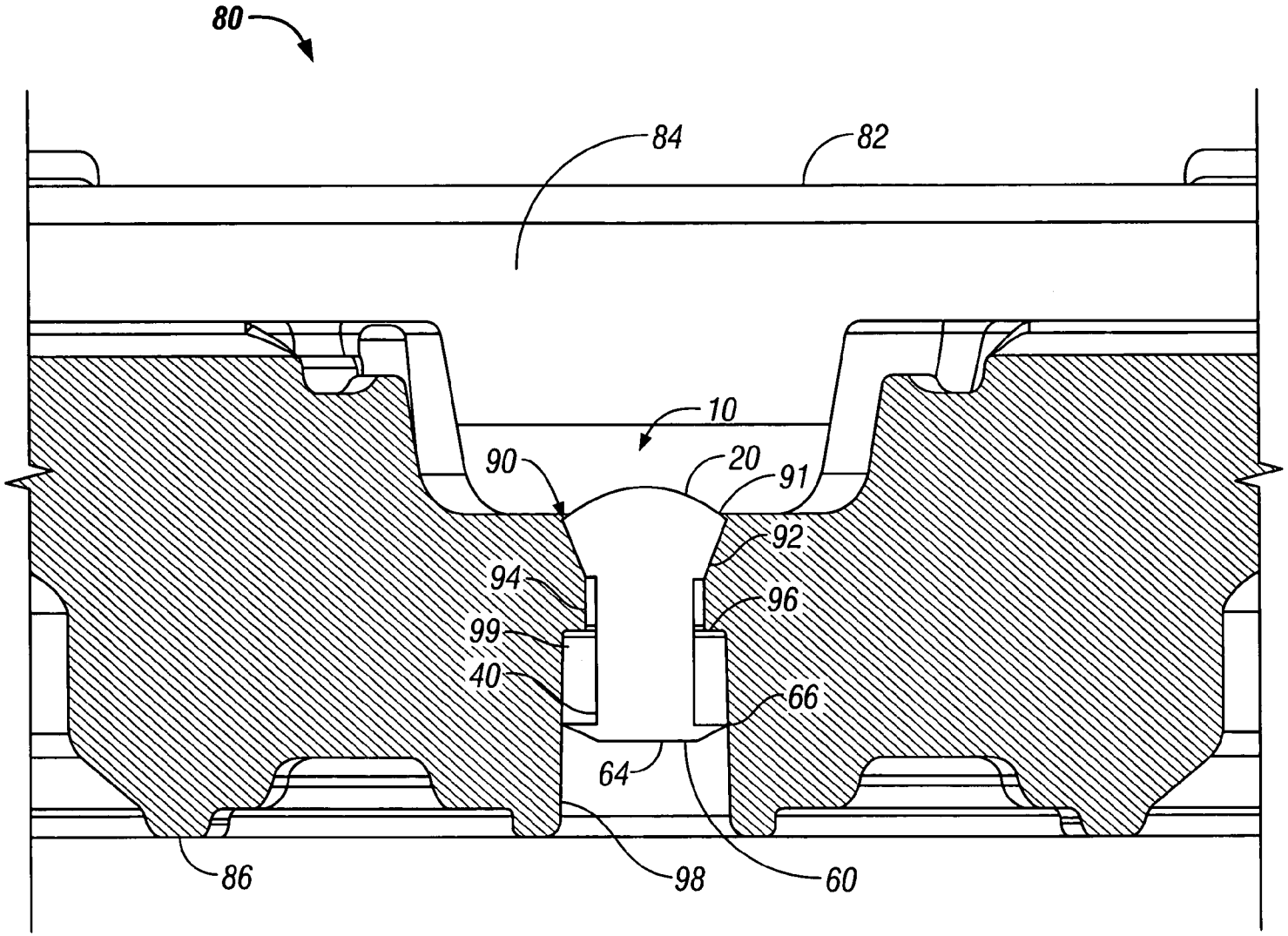
FIG. 3 is a cross-sectional view of the drain plug illustrated in FIG. 1 in a sealed position within the container.

The head 20 includes an outer surface 22, an inner surface 24 defined by a cavity 26 and a bottom 28. The head 20 is beveled such that the circumference of the top edge 30 of the head 20 is larger than the circumference at the bottom edge 32 of the head 20. As shown in FIG. 3, the beveled shape of the head 20 mates with the opening 90 in a container 80 to seal the opening in the container.

The head 20 also includes an integrally formed handle 34 extending from the bottom of the head 20. In the illustrated embodiment, the handle 34 is arc-shaped. However, the handle 34 may be formed from various shapes, such as rectangular. The handle 34 is disposed within the cavity 26 and extends across the center of the head 20. The handle 34 divides the cavity 26 in half. The divided cavity 26 provides a space for the user to place their fingers when engaging the handle 34. The arc-shaped handle 34 extends above the top edge 30 of the head 20 thereby facilitating engagement of the handle. To use the drain plug, a user would engage the handle to pull the plug in an upwardly direction to place the plug in a drainage position or a user would engage the handle to push the plug in a downwardly direction to place the plug in a sealed position.

The integrally formed upright section 40 of the drain plug extends from the center of the bottom 28 of the head 20 to the center of the top 62 of the base 60 thereby separating the head 20 and base 60 of the drain plug 10. The upright section 40 provides support for the head 20 and base 60 of the drain plug. The upright section 40 includes a plurality of elongate elements 42 that are arranged perpendicular to each other. In the illustrated embodiment, the elongate elements 42 consist of four in number and are arranged in a cross-shape fashion. The elongate elements 42 may be formed such that they intersect at various angles thereby forming various shapes, such as an X-shape. The height of the upright section 40 can also vary depending on the length of the opening in the container.

The base 60 of the drain plug 10 is circular with a top surface 62 and a bottom surface 64. The base 60 includes a flexible peripheral edge 66 which uniformly tapers to a circumferential rib portion 68. The base 60 of the drain plug 10 is designed so that the drain plug 10 may not be removed from the container 80. As such, the peripheral edge 66 of the base 60 provides a stop which, as discussed with respect to FIG. 4, allows the drain plug 10 to remain in an upright drainage position within the container.

Figure 2:
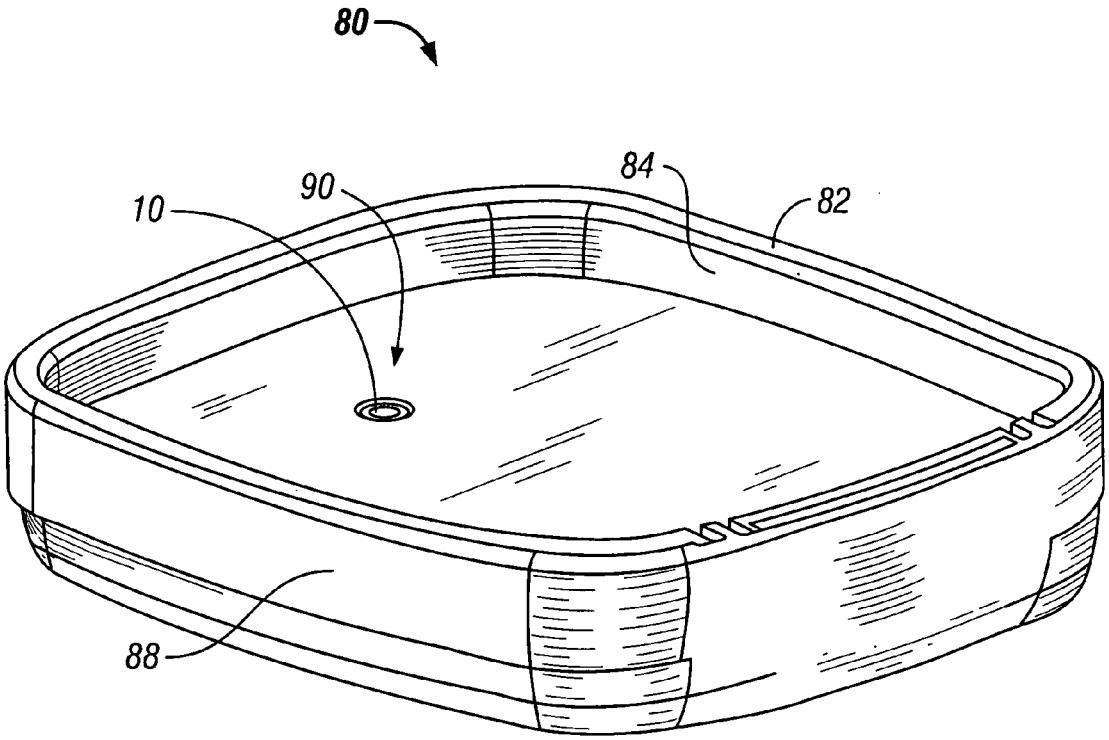
FIG. 2 is a perspective view of the drain plug of FIG. 1 installed in a container.

FIG. 2 illustrates the drain plug installed in a container. In the illustrated embodiment, container 80 has a rectangular shape. The drain plug, however, may be installed in a variety of containers, such as a cylindrical or a circular shaped container. The container 80 has a plurality of sides 82, an inner surface 84, an outer surface 88, a bottom surface 86 and an opening 90. The drain plug 10 is permanently installed within the opening 90 of a container 80. As shown in FIG. 3, the opening 90 extends from the inner surface 84 of the container 84 of the container 80 to the bottom surface of the container defining the structure of the outer surface 88 of the container 80 therebetween.

The opening 90 defines the outer surface 88 of the container to include a curved edge 91 that leads to a beveled section 92. The beveled section 92 extends from the curved edge 91 at the inner surface 84 of the container to a cylindrical section 94. A step 96 having a flat surface extends from the cylindrical section 94 outwardly to the outer surface 88. A tapered section 98 extends downwardly from the end of the step 96 that is opposite of the cylindrical section 94. The tapered section 98 extends downwardly to the bottom 86 of the container. The tapered section 98 tapers approximately one degree to enable an interference fit between the tapered section 98 of the container and the flexible peripheral edge 66 of the base 60 of the plug (see FIG. 4).

When the drain plug 10 is in a sealed position (see FIG. 3), the outer surface 22 of the head 20 matingly engages the beveled section 92 of the container. In the illustrated embodiment, the beveled section 92 accommodates the drain plug 10 from the top edge 30 of the head 20 to the bottom edge 32 of the head. This arrangement allows liquid to remain in the container as long as the user desires. While the drain plug is in a sealed position, the upright portion 40 is situated in the center of the opening 90 of the container. The peripheral edge 66 of the base 60 is adjacent to, but not in contact with, the outer surface tapered section 98.

Figure 4:
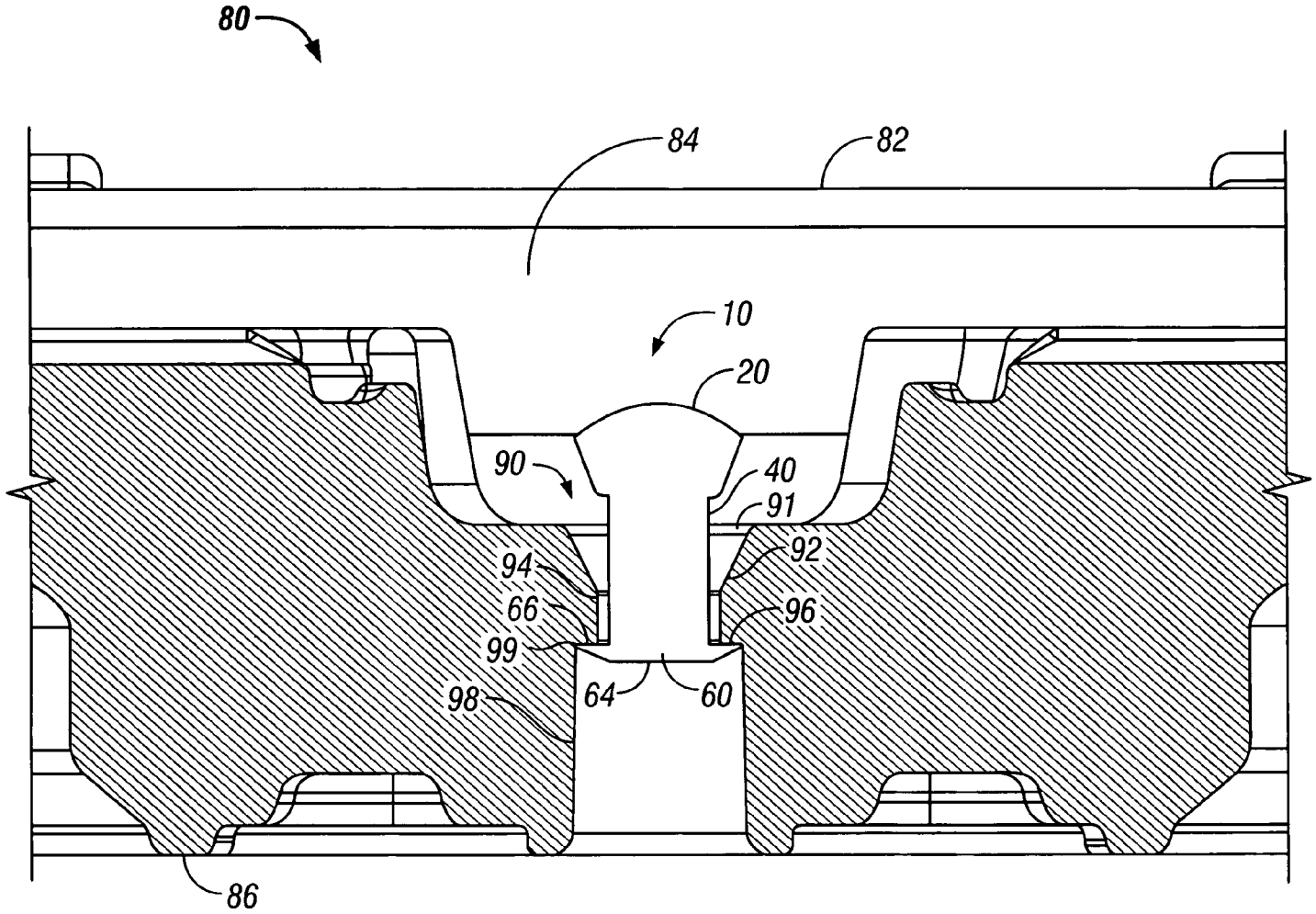
FIG. 4 is a cross-sectional view of the drain plug illustrated in FIG. 1 in a drainage position within the container.

As shown in FIG. 4, the drain plug remains positioned within the opening in the drainage position. To drain the container, a user pulls the handle 34 of the plug upwards until the drain plug is secured in a standing drainage position. As the user pulls the plug upwards, the peripheral edge 66 of the base 60 begins to flex as it contacts the upper portion 99 of the tapered section 98. The upper portion 99 of tapered section 98 provides a graduated interference fit between the tapered section 98 and the peripheral edge 66 of the base 60. The interference fit provides a secure connection that allows the plug to remain in an upright drainage position.

Once the peripheral edge 66 contacts the upper portion 99 of the tapered section 98, the drain plug may no long move in an upward direction. As a result, the base 60 of the drain plug remains positioned below the cylindrical section 94 and the step 96. Thus, the step 96 and the cylindrical section 94 of the container remain open thereby allowing the liquid in the container to drain over the circumferential ribs 68 of the base 60 of the plug and out of the container.

As seen in FIG. 1, the bases includes openings 70 radially inwardly of the circumferential ribs 68 over which the liquid drains, the openings 70 allowing the liquid to drain out of the container.

Therefore, while the invention has been described with respect to the illustrated embodiment, it is not limited thereto, but only by the scope and spirit of the appended claims.

What is claimed is:

1. An apparatus for holding a liquid, comprising:

a container having an opening extending through a wall of the container from an inner side toward an outer side of the wall, the opening having a tapered section bounded by an annular wall surface of the container that tapers outwardly going from an inner end to an outer end of the tapered section; and a plug retained in the opening and movable outwardly from a closed position to a drainage position, the plug having a base with a peripheral edge having an outer diameter greater than the diameter of the tapered section at the inner end of the tapered section, such that the peripheral edge of the base provides an interference fit with the annular wall surface bounding the tapered section of the opening when the plug is moved from its closed position to the drainage position, thereby enabling the plug to remain in the drainage position.

2. The apparatus of claim 1, wherein the plug has a head with a top edge having a circumference and a bottom edge having a circumference, wherein the circumference of the head of the plug decreases from the top edge to the bottom edge.

3. The apparatus of claim 1, wherein an inner section of the opening is bounded by a beveled surface of the container, and the plug has a head for engaging the beveled surface when the plug is in its closed position to seal the opening in the container.

4. The apparatus of claim 1, wherein the plug has a head including an inwardly opening cavity and a handle disposed within the cavity for facilitating engagement of the handle.

5. The apparatus of claim 1, wherein the plug has an upright portion connecting the base to the head.

6. The apparatus of claim 1, wherein the base has a circumferential rib, the base tapers going radially outwardly from the circumferential rib.

7. The apparatus of claim 1, wherein the tapered section tapers at least one degree.

8. A plug for closing a drain opening in a container, said plug comprising:

a head with a top edge and a bottom edge, wherein the circumference of the head decreases from the top edge to the bottom edge;

an upright with opposing ends, wherein one end of the upright is integrally connected to the head; and a base integrally connected to a second end of the upright, wherein the base includes a radially inward generally circular portion including drainage openings and a flexible peripheral edge extending radially outwardly from the circular portion;

wherein the plug is a unitary molded component formed of plastic, whereby the peripheral edge is flexible.

9. The apparatus of claim 1, wherein the peripheral edge of the base is resiliently flexible.

10. The apparatus of claim 1, wherein the peripheral edge of the base is tapered.

11. The apparatus of claim 1, wherein the base includes a radially inward generally circular portion including drainage openings and the peripheral edge extends radially outwardly from the circular portion.

12. The apparatus of claim 11, wherein the plug is an unitary molding.

13. The apparatus of claim 1, wherein the peripheral edge has an outer diameter less than the diameter of the tapered section at the outer end of the tapered section.

* * * * *